US007334649B2

(12) United States Patent
Chen et al.

(10) Patent No.: US 7,334,649 B2
(45) **Date of Patent: *Feb. 26, 2008**

(54) DRILLING WITH CASING

(75) Inventors: Chen-Kang D. Chen, Houston, TX (US); M. Vikram Rao, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 244 days.

This patent is subject to a terminal disclaimer.

(21) Appl. No.: 11/103,186

(22) Filed: Apr. 11, 2005

(65) Prior Publication Data

US 2005/0236187 A1 Oct. 27, 2005

Related U.S. Application Data

(63) Continuation-in-part of application No. 10/320,164, filed on Dec. 16, 2002, now Pat. No. 6,877,570.

(51) Int. Cl.
*E21B 7/20* (2006.01)

(52) U.S. Cl. ..... 175/22; 175/73; 175/171

(58) Field of Classification Search ..... 175/22, 175/73, 171, 45, 61, 62, 74, 75, 107, 263, 175/265, 384, 385

See application file for complete search history.

(56) References Cited

U.S. PATENT DOCUMENTS 1,500,001 A 7/1924 Rogers
3,552,509 A 1/1971 Brown
3,661,218 A 5/1972 Brown
5,168,942 A 12/1992 Wydrinski
5,186,265 A 2/1993 Henson et al.
5,197,533 A 3/1993 Behrends
5,271,472 A 12/1993 Leturno
5,343,964 A 9/1994 Leroy
5,472,051 A 12/1995 Brothers
5,678,644 A 10/1997 Fielder
5,853,053 A * 12/1998 Gilchrist et al. ..... 175/101
5,957,223 A 9/1999 Doster et al.
5,992,548 A 11/1999 Silva et al.
6,059,051 A 5/2000 Jewkes et al.

(Continued)

OTHER PUBLICATIONS

SPEC/IADC 52789, R.M. (Bob) Tessari, SPE, and Garret. Case Drilling—A Revolutionary Approach to Reducing Well Costs Madell, SPE, Tesco Corporation, Mar. 9-11, 1999, pp. 1-11.

(Continued)

*Primary Examiner*—Kenneth Thompson
(74) *Attorney, Agent, or Firm*—Browning Bushman P.C.

(57) ABSTRACT

A borehole may be drilled utilizing the bottom hole assembly 10, 50 with a downhole motor 14, 110, which may offset at a selected bend angle. A bend for directional drilling may be provided by a PDM, or by a RSD. A gauge section 36 secured to the pilot bit 18 has a uniform diameter bearing surface along an axial length of at least 60% of the pilot bit diameter. The bit or reamer 16 has a bit face defining the cutting diameter of the drilled hole. The axial spacing between the bend and the bit face is controlled to less than fifteen times the bit diameter. The downhole motor, pilot bit and bit may be retrieved from the well while leaving the casing string in the well.

36 Claims, 3 Drawing Sheets

U.S. PATENT DOCUMENTS

| | | | | |
|---|---|---|---|---|
| 6,118,531 | A | 9/2000 | Hertel et al. | |
| 6,123,368 | A | 9/2000 | Enderle | |
| 6,158,531 | A | 12/2000 | Vail, III | |
| 6,269,892 | B1 | 8/2001 | Boulton et al. | |
| 6,298,929 | B1 | 10/2001 | Rojas | |
| 6,340,064 | B2 | 1/2002 | Fielder et al. | |
| 6,394,200 | B1 | 5/2002 | Watson et al. | |
| 6,470,977 | B1 | 10/2002 | Chen et al. | |
| 6,581,699 | B1 | 6/2003 | Chen et al. | |
| 6,705,413 | B1 | 3/2004 | Tessari | |
| 6,848,518 | B2 * | 2/2005 | Chen et al. | 175/61 |
| 6,877,570 | B2 * | 4/2005 | Chen et al. | 175/22 |
| 2003/0010534 | A1 * | 1/2003 | Chen et al. | 175/61 |
| 2006/0266555 | A1 * | 11/2006 | Chen et al. | 175/61 |

OTHER PUBLICATIONS

IADC/SPE 62780, E. Skinazi, SPE; R. Deady, SPE; D. Robson; C. Konschuh; Sperry Sun Drilling Services. Devlopment of a Case/Drilling System Improves the Drilling Process, IADC/SPE Asia Specific Drilling Technology, Sep. 11-13, 2000, pp. 1-6.

IADC/SPE 67731, S.F. Shepard, SPE, and R.H. Reiley, SPE BP, and T.M. Warren, SPE, Tesco Corp., Case Drilling: An Emerging Technology, SPE/IADC Drilling Conference. Feb. 27-Mar. 1, 2001, pp. 1-13.

* cited by examiner

DRILLING WITH CASING

RELATED CASE

This application is a continuation in part of U.S. application Ser. No. 10/320,164 filed Dec. 16, 2002 now U.S. Pat. No. 6,877,570.

FIELD OF THE INVENTION

The present invention relates to technology for drilling an oil or gas well, with the casing string remaining in the well after drilling. More particularly, the present invention relates to techniques for improving the efficiency of drilling a well with casing, with improved well quality providing for enhanced hydrocarbon recovery, and with the technology allowing for significantly reduced costs to reliably complete the well.

BACKGROUND OF THE INVENTION

Most hydrocarbon wells are drilled in successively lower casing sections, with a selected size casing run in a drilled section prior to drilling the next lower smaller diameter section of the well, then running in a reduced diameter casing size in the lower section of the well. The depth of each drilled section is thus a function of (1) the operator's desire to continue drilling as deep as possible prior to stopping the drilling operation and inserting the casing in the drilled section, (2) the risk that upper formations will be damaged by high pressure fluid required to obtain the desired well balance and downhole fluid pressure at greater depths, and (3) the risk that a portion of the drilled well may collapse or otherwise prevent the casing from being run in the well, or that the casing will become stuck in the well or otherwise practically be prevented from being run to the desired depth in a well.

To avoid the above problems, various techniques for drilling a well with casing have been proposed. This technique inherently runs the casing in the well with the bottom hole assembly (BHA) as the well, or a section of the well, is being drilled. U.S. Pat. Nos. 3,552,509 and 3,661,218 disclose drilling with rotary casing techniques. U.S. Pat. No. 5,168,942 discloses one technique for drilling a well with casing, with the bottom hole assembly including the capability of sensing the resistivity of the drilled formation. U.S. Pat. No. 5,197,533 also discloses a technique for drilling a well with casing. U.S. Pat. No. 5,271,472 discloses yet another technique for drilling the well with casing, and specifically discloses using a reamer to drill a portion of the well with a diameter greater than the OD of the casing. U.S. Pat. No. 5,472,051 discloses drilling a well with casing, with a bottom hole assembly including a drill motor for rotating the bit, thereby allowing the operator at the surface to (a) rotate the casing and thereby rotate the bit, or (b) rotate the bit with fluid transmitted through the drill motor and to the bit. Still another option is to rotate the casing at the surface and simultaneously power the drill motor to rotate the bit. U.S. Pat. No. 6,118,531 discloses a casing drilling technique which utilizes a mud motor at the end of coiled tubing to rotate the bit. SPE papers 52789, 62780, and 67731 discuss the commercial advantages of casing drilling in terms of lower well costs and improved drilling processes.

Problems have nevertheless limited the acceptance of casing drilling operations, including the cost of casing capable of transmitting high torque from the surface to the bit, high losses between the surface applied torque and the torque on the bit, high casing wear, and difficulties associated with retrieving the bit and the drill motor to the surface through the casing.

The disadvantages of the prior art are overcome by the present invention, and improved methods of casing drilling are hereinafter disclosed which will result in a casing run in a well during a casing drilling operation, with lower costs and improved well quality providing for lower cost and/or enhanced hydrocarbon recovery.

SUMMARY OF THE INVENTION

The present invention provides for casing drilling, wherein a well is drilled utilizing a bottom hole assembly at the lower end of the casing string and a downhole motor with a selected bend angle, such that the pilot bit and reamer (or bi-centered bit) when rotated by the motor have an axis offset at a selected bend angle from the axis of the power section of the motor. According to the invention, the motor housing may be "slick", meaning that the motor housing has a substantially uniform diameter outer surface extending axially from the upper power section to the lower bearing section. The motor may be a positive displacement motor (PDM) with a bend in the housing, or may be a rotary steerable device (RSD) with a cylindrical housing and a bend in the rotary shaft. The RSD may be driven from the surfaces, but more preferably will be driven by a PDM without a bend in the housing (straight PDM), with rotation optimally being supplemented by rotation of the casing string. A gauge section is provided secured to the pilot bit, and has a uniform diameter surface thereon along an axial length of at least about 60% of the bit diameter. The reamer may thus be rotated by rotating the casing string at the surface, but may also be rotated by pressurized fluid passing through the downhole motor to rotate the pilot bit and the reamer. The casing string remains in the well and the downhole motor, pilot bit and reamer may be retrieved from the well.

It is a feature of the invention that the pilot bit may be rotated with the casing string to drill a relatively straight section of the wellbore, and that the downhole motor may be powered to rotate the pilot bit with respect to the non-rotating casing string to drill a deviated portion of the wellbore.

Another feature of the invention is that the gauge section secured to the pilot bit may have an axial length of at least 75% of the pilot bit diameter.

Yet another feature of the invention is that the interconnection between the downhole motor and the reamer or bi-centered bit is preferably accomplished with a pin connection at the lower end of the downhole motor and a box connection at the upper end of the reamer.

A significant feature of the present invention is that casing while drilling operations may be performed with the improved bottom hole assembly, with the casing string utilizing relatively standard connections, such as API coupling connections, rather than special connections required for casing while drilling operations utilizing a conventional bottom hole assembly.

Another feature of the present invention is that the bottom hole assembly significantly reduces the risk of sticking the casing in the well, which may cost a drilling operation tens of thousands of dollars.

An advantage of the present invention is that the bottom hole assembly does not require especially made components. Each of the components of the bottom hole assembly may be selected by the operator as desired to achieve the objectives of the invention.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
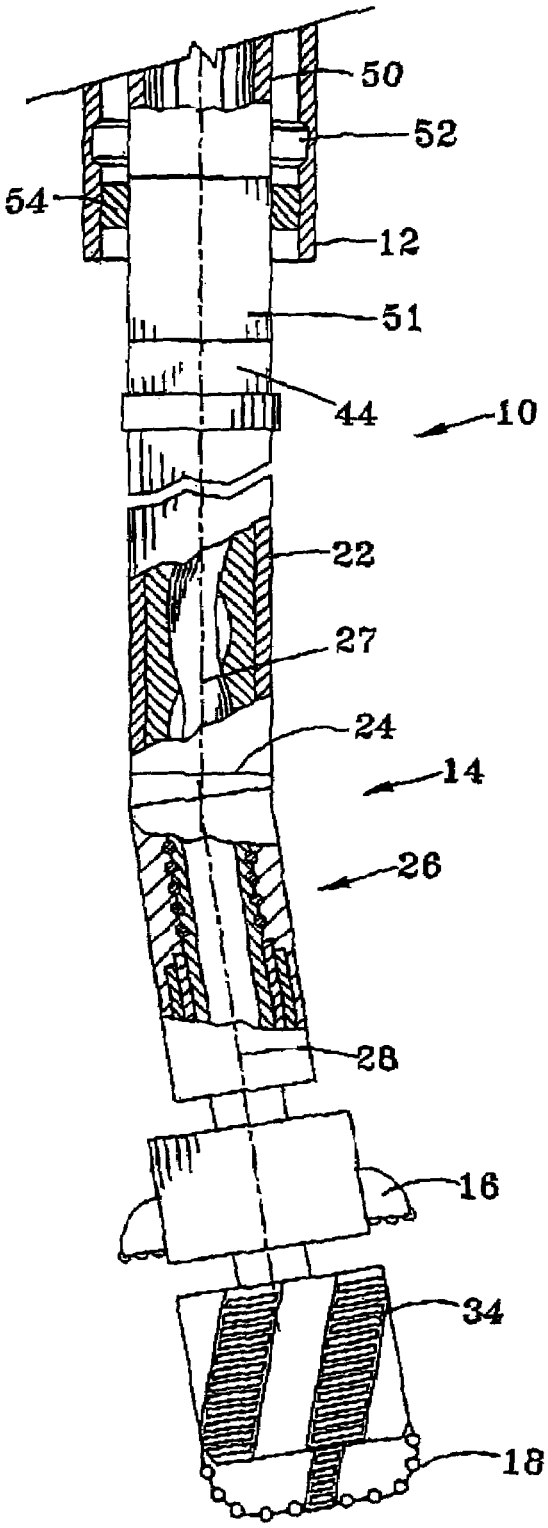
FIG. 1 generally illustrates a well drilled with a bottom hole assembly at the lower end of a casing string and a downhole motor with a bend, a reamer and a pilot bit.

FIG. 1 generally illustrates a well drilled with a bottom hole assembly (BHA) 10 at the lower end of a casing string 12. The BHA 10 includes a fluid powered downhole motor 14 with a bend for rotating a bit 16 to drill a deviated portion of the well. A straight section of the well may be drilled by additionally rotating the casing string 12 at the surface to rotate the bit 16, which as explained subsequently may be either a reamer or a bi-centered bit. To drill a curved section of the borehole, the casing is slid (non-rotating) and the downhole motor 14 rotates the bit 16. It is generally desirable to rotate the casing string to minimize the likelihood of the casing string becoming stuck in the borehole, and to improve return of cuttings to the surface. In the preferred embodiment, a bend in the bottom hole assembly has a bend angle of less than about 3.

Since the bit 16 which drills the borehole has a cutting diameter greater than the OD of the casing, and since the bit is retrieved through the ID of the casing after the casing is run in the well, the bit in many applications will be a reamer. The bit 16 alternatively may be a bi-centered bit, or any other cutting tool for cutting a borehole diameter greater than the OD of the casing. A pilot bit 18 has a cutting diameter less than the ID of the casing and may be fixed to the bit or reamer 16, with the cutting diameter of the reamer or the bi-centered bit being significantly greater than the cutting diameter of the pilot bit. The downhole motor 14 may be run "slick", meaning that the motor housing has a substantially uniform diameter from the upper power section 22 through the bend 24 and to the lower bearing section 26. No stabilizers need be provided on the motor housing, since neither the motor housing nor a small diameter stabilizer is likely to engage the borehole wall due to the enlarged diameter borehole formed by the bit 16. The motor housing may include a slide or wear pad. A downhole motor which utilizes a lobed rotor is usually referred to as a positive displacement motor (PDM).

The downhole motor 14 as shown in FIG. 1 has a bend 24 between the upper axis 27 of the motor housing and the lower axis 28 of the motor housing, so that the axis for the bit 16 is offset at a selected bend angle from the axis of the lower end of the casing string. The lower bearing section 26 includes a bearing package assembly which conventionally comprises both thrust and radial bearings.

Figure 2:
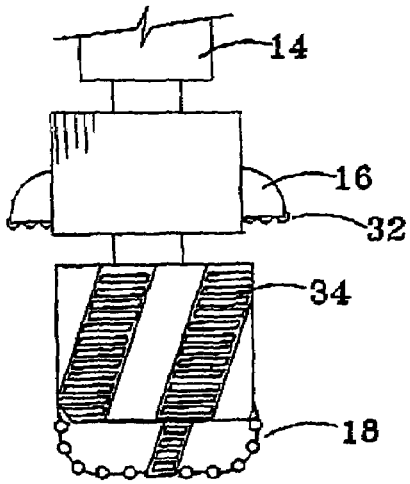
FIG. 2 illustrates in greater detail a pilot bit, a gauge section secured to the pilot bit, and a reamer.
Figure 3:
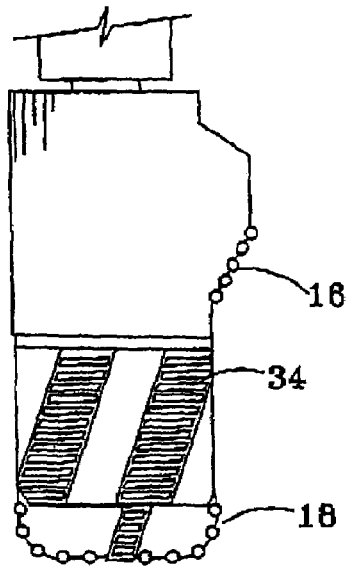
FIG. 3 illustrates a pilot bit, and a gauge section secured to the pilot bit, and a bi-centered bit.

The bit 16, which in many applications will be a reamer, has an end face which is bounded by and defines a bit cutting diameter. When the bit is a reamer, the reamer will have a face which defines the reamer cutting diameter. In either case, the face of the cutters may lie within a plane substantially perpendicular to the central axis of the bit, as shown in FIG. 2, or the cutters could be inclined, as shown in FIG. 3. The bit cutting diameter, in either case, is the diameter of the hole being drilled, and thus the radially outermost cutter's final location defines the bit cutting diameter. The gauge section 34 is below the reamer 16, and is rotatably secured to and/or may be integral with the bit 16 and/or the pilot bit 18. The axial length of the gauge section ("gauge length") is at least 60% of the pilot bit diameter, preferably is at least 75% of the pilot bit diameter, and in many applications may be from 90% to one and one-half times the pilot bit diameter. In a preferred embodiment, the bottom of the gauge section may be substantially at the same axial position as the pilot bit face, but could be spaced slightly upward from the pilot bit face. The top of the gauge section preferably is only slightly below the cutting face of the bit or reamer 16, although it is preferred that the axial space between the bottom of the gauge section and the pilot bit face is less than the axial spacing between the top of the gauge section and the face of the bit or reamer 16. The diameter of the gauge section may be slightly under gauge with respect to the pilot bit diameter.

The axial length of the gauge section is measured from the top of the gauge section to the forward cutting structure of the pilot bit at the lowest point of the full diameter of the pilot bit, e.g., from the top of the gauge section to the pilot bit cutting face. Preferably no less than 50% of this gauge length forms the substantially uniform diameter cylindrical bearing surface when rotating with the bit. One or more short gaps or under gauge portions may thus be provided between the top of the gauge section of the bottom of the gauge section. The axial spacing between the top of the gauge section and the pilot bit face will be the total gauge length, and that portion which has a substantially uniform diameter rotating cylindrical bearing surface preferably is no less than about 50% of the total gauge length. Those skilled in the art will appreciate that the outer surface of the gauge section need not be cylindrical, and instead the gauge section is commonly provided with axially extending flutes along its length, which are typically provided in a spiral pattern. In that embodiment, the gauge section thus has a substantially uniform diameter surface defined by the cutters on the flutes which form the cylindrical surface thereon while rotating. The gauge section may thus have steps or flutes, but the gauge section nevertheless defines a rotating cylindrical surface. The pilot bit 16 may alternatively use roller cones rather than fixed cutters.

FIG. 2 shows in greater detail a suitable bit 16, such as a reamer, which has a cutting diameter 32. Rotatably fixed to the bit 16 is a gauge section 34 which has a uniform surface thereon providing a uniform diameter cylindrical bearing surface along an axial length of at least 60% of the pilot bit diameter, so that the gauge section and pilot bit 18 together form a long gauge pilot bit. As noted above, the gauge section preferably is integral with the pilot bit, but the gauge section may be formed separate from the pilot bit then rotatably secured to the pilot bit. The reamer 16 would normally be formed separate from then rotatably secured to the gauge section 34, although one could form the reamer body and the gauge section as an integral body. When the reamer is bi-centered at 16, as shown in FIG. 3, the bi-centered bit body preferably is integral with the body of gauge section 34. The gauge section preferably has an axial length of at least 75% of the pilot bit diameter. The bit or reamer 16 may be structurally integral with the gauge section 34, or the gauge section may be formed separate from then rotatably secured to the reamer. The bit or reamer 16 includes cutters which move radially outward to a position typically less than, or possibly greater than, 120% of the casing diameter. In many applications, the radially outward position of the cutters on the reamer will be about 115% or less than the casing diameter. The cutters on the reamer 16 may be hydraulically powered to move radially outward in response to an increase in fluid pressure in the bottom hole assembly. Alternatively, a wireline intervention tool can be lowered in the well to move the cutters radially outward and/or radially inward. In yet other embodiments, the cutters may move radially in response to a J-slot mechanism, or to weight on bit. FIG. 3 illustrates a bi-centered bit 16 replacing the reamer.

Figure 4:
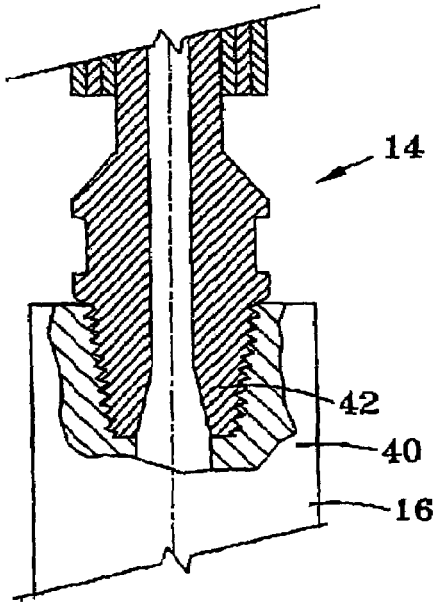
FIG. 4 illustrates a box connection on the reamer connected with a pin connection on the motor.

FIG. 4 depicts a box connection 40 provided on the reamer 16 for threaded engagement with the pin connection 42 at the lower end of the downhole motor 14. The preferred interconnection between the motor and the reamer is thus made through a pin connection on the motor and the box connection on the reamer.

According to the BHA of the present invention, the first point of contact between the BHA and the wellbore is the pilot bit face, and the second point of contact between the BHA and the wellbore is along the axial length of gauge section 34. The third point of contact is the bit or reamer 16, and the fourth point of contact above the downhole motor, and preferably will be along an upper portion of the BHA or along the casing itself. This fourth contact point, is however, spaced substantially above the first, second and third contact points.

BHA 10 as shown in FIG. 1 preferably includes an MWD (measurement-while-drilling) tool 40 in the casing string above the motor 14. This is a desirable position for the MWD tool, since it may be less than about 30 meters, and often less than about 25 meters, between the MWD tool and the end of the casing string 12.

Figure 5:
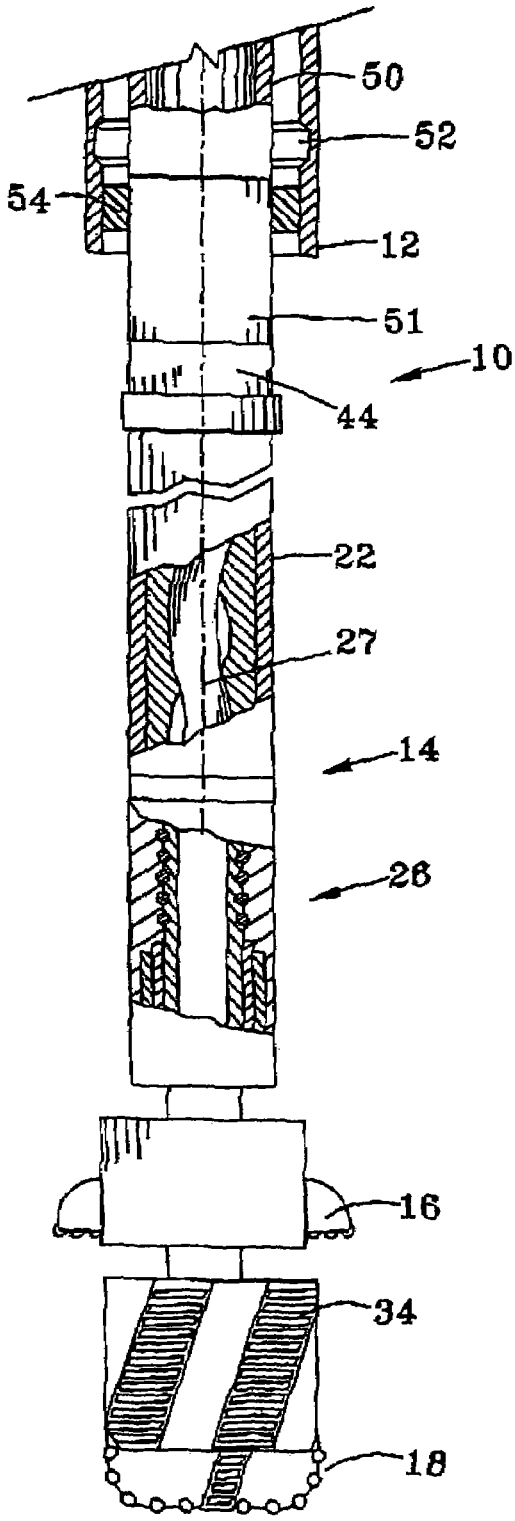
FIG. 5 illustrates a downhole motor without a bend, but with a reamer and a pilot bit.

For the FIG. 5 embodiment, the BHA is not used for directional drilling operations, and accordingly the motor 14 does not have a bend in the motor housing. The motor is, however, powered to rotate the bit, or the casing itself is generally slid in the well, but also may be rotated while the motor is powering the bit. The BHA 50 as shown in FIG. 4 may thus be used for substantially straight drilling operations, with the benefits discussed above.

A significant feature of the present invention is that the BHA allows for the use of casing with conventional threaded connectors, such as API (American Petroleum Institute) connectors commonly used in casing operations which do not involve rotation of the casing string. Conventionally, an API connector 62 shown in FIG. 7 may thus be used for interconnecting the casing joints. This advantage is significant, since then special premium high torque connectors need not be provided on the joints of the casing or the other tubular components of the casing string. Use of conventional components already in stock significantly lowers installation and maintenance costs.

As shown in FIGS. 1 and 5, the MWD package 44 is provided below a lowermost end of the casing 12. The retrievable downhole motor 14 may be powered by passing fluid through the casing, and then into the downhole motor. The motor 14 may be supported from the casing with a latching mechanism 51, which absorbs the torque output from the motor 14. Fluid may be diverted through the latching mechanism, then to the motor and then the reamer and the bit. Those skilled in the art will appreciate the downhole motor may be latched to the casing string 12 by various mechanisms, including the plurality of circumferentially arranged dogs 52 which fit into corresponding slots in the casing 12. A packer or other seal assembly 54 may be provided for sealing between the BHA and the casing string 12. After the hole is drilled, the dogs 52 on the latching mechanism 51 may be hydraulically activated to move to a release position, and the motor 14, the retracted cutting elements in the bit or reamer 16, the gauge section 34, and the pilot bit 18 may then be retrieved to the surface. A retrieving tool similar to those used in multilateral systems may be employed. Alternatively, the reamer cutters may be cut off or otherwise separated from the body of the reamer. A casing shoe at the lower end of the casing string may have the ability to cut off the reamer blades, so that the reamer blades may be cut off rather than retracted, and this option may be used in some applications. In a preferred embodiment, the downhole assembly may be retrieved by the wireline with the casing 12 remaining in the well. Alternatively, a work string 50 may be used to retrieve the motor.

It should also be understood that a pilot bit, gauge section, and reamer as discussed above may be secured at the lower end of the casing string for casing drilling operation when rotating the casing string, which is conventionally rotated when drilling straight sections of the borehole. Significant advantages are, however, realized in many operations to drill at least a portion of the well with the bit or reamer being powered by a downhole motor, sometimes with the casing not rotated to enable drilling directionally. During drilling of the length of the borehole to total depth, TD, the casing may remain in the hole and the bottom hole assembly including the downhole motor and bit returned to the surface for repair or replacement of bits. When the total depth of a well is reached, the downhole assembly may similarly be retrieved to the surface, although in some applications when reaching TD, the bit, reamer, and pilot bit assembly, or the bit assembly and the motor, may remain in the well, and only the MWD assembly retrieved to the surface.

The BHA in the present invention substantially reduces the torque which must be imparted to the casing string 12 when drilling a straight section of the borehole. When rotating casing string 12 within a well, a significant problem concerns "stick-slip", which causes torque spikes along the casing string when rotation is momentarily stopped and then restarted. Undesirable stick-slip forces will likely be particularly high in the upper portion of the drill string, where torque on the casing string 12 imparted at the surface is highest. Since the torque imparted to the casing string 12 according to the present invention is significantly reduced, the consequences of stick-slip of the casing string 12 are similarly reduced, thereby further reducing the robust requirements for the casing connectors.

By using a reduced torque motor in the context of this invention, there is substantially less motor torque, and thus also less "reverse" or reactive torque generated when the bit motor stalls and the bit rotated by the motor suddenly stops. The high peaks of this variable reverse torque causes torque spikes propagating upward from the motor to the lower portion of the casing string. The lower portion of casing string may thus briefly "wind up" when bit rotation is stopped. Reverse torque is thus also reduced, allowing for more economical casing connectors.

Downhole motor is powered to rotate the bit and drill a deviated portion of the well, desirably high rates of penetration often may be achieved by rotating the bit at less than 350 RPM. Reduced vibrations results from the use of a long gauge above the bit face and the relatively short length between the bend and the bit, thereby increasing the stiffness of the lower bearing section. The benefits of improved borehole quality include reduced hole cleaning expense, improved logging operations and log quality, easier casing runs and more reliable cementing operations. The BHA has low vibration, which again contributes to improved borehole quality. Drilling with casing techniques are currently used on a very low percentage of wells. Efforts to improve borehole quality with a BHA as disclosed in U.S. Pat. No. 6,269,892 and would not solve the primary problem with casing drilling operations, which involves the high cost of the casing string due to special connectors, equipment failure due to vibration, and difficulty with retrieving the downhole motor and bit through the casing string. U.S. Pat. No. 6,470,977 discloses a bottom hole assembly for reaming a borehole. The present invention applies technology directed to a bottom hole assembly which provides for significant improvements in borehole quality, but the benefits of improved borehole quality will be secondary to the significant reduction in costs and increased reliably for successfully completing a casing drilling operation.

The downhole assembly of the present invention is able to drill a hole utilizing less weight on bit and thus less torque than prior art BHAs, and is able to drill a "truer" hole with less spiraling. The casing itself may thus be thinner walled than casing used in prior art casing drilling operations, or may have the same wall thickness but may be formed from less expensive materials. The cost of casing suitable for conventional casing drilling operations is high, and the forces required to rotate the bit to penetrate the formation at a desired drilling rate may be lowered according to this invention, so that less force is transmitted along the casing string to the bit. Since the drilled hole is truer, there is less drag on the casing string, and the operator has more flexibility with respect to the weight on bit to be applied at the surface through the casing string. Since there is less engagement with the borehole wall both when sliding the casing in the hole with the drill motor being powered to form a deviated portion of the wellbore, and when rotating the casing string from the surface to rotate the bit when drilling a straight section of the borehole, there is substantially less wear on the casing during the drilling operation, which again allows for thinner wall and/or less expensive casing.

The primary advantage of the present invention is that it allows casing drilling operations to be conducted more economically, and with a lower risk of failure. The truer hole produced according to casing drilling using the present invention not only results in lower torque and drag in the well, but reduces the likelihood of the casing becoming stuck in the well. Another significant advantage relates to increased reliability of retrieving the bit through the casing string to the surface. As previously noted, the cutting diameter of the bit or reamer must be greater than the OD of the casing, but the bit must be retrieved through the ID of the casing. Various devices had been devised for insuring easy retrievability, but all devices are subject to failure, which to a large extent is attributable to high vibration of the BHA. High vibrations for the BHA may thus lead to casing connection failures, bit failures, and motor failures, and thus will adversely affect the reliability of the mechanism which requires the bit cutting diameter be reduced to fit within the ID of the casing string, so that the motor and bit may be retrieved to the surface. The relatively smooth wellbore resulting from the BHA of this invention provides for better cementing and hole cleaning. The BHA not only results in reduced costs to run the casing in the well, but also results in better ROP, better steerability, improved reamer reliability, and reduced drilling costs.

According to the prior art, a PDM driving a reamer or bi-centered bit and a conventional pilot bit would be minimally supported radially by the borehole, and thus would be relatively limber, unbalanced, and therefore prone to creating vibration. Further, when rotating this unbalanced assembly, undesirable stick-slip may be high. Since these torque events would often be greater than the rated torque for standard API casing joint connections, and since failure of a connection would be a significant cost, prior art casing drilling has used specially designed, costly, and higher strength casing connectors. Prior art casing drilling operations require a high amount of torque to be transmitted to the casing string at the surface in order to overcome the static friction and the dynamic friction required to rotate the casing string in the well when drilling a straight section of the borehole. Frictional losses may be significantly reduced utilizing a bottom hole assembly of the present invention, since the truer borehole resulting from the bottom hole assembly reduces the drag between the casing string and the formation.

When the casing is being slid (non-rotating from surface) and the motor is rotating to the bit, there is less torque generation required by the motor using this BHA, by virtue of the pilot bit and the gauge section, and absence of non-constructive bit behaviors. Less aggressive bits and lower torque motors are thus preferred. This combination also reduces reverse torque due to motor stalling. Since a less aggressive bit takes less of a bite out of the rock, and since the pilot bit and gauge section result in each bite being the desired and properly aimed bite, high instantaneous torque and the likelihood of a stall are minimized. If the motor does stall, the low torque motor ensures that the reactive or reverse torque spike is lower, since the reactive torque cannot be any greater than the torque capacity of the motor.

When rotating the casing from the surface for hole cleaning, removal of the directionality, or reducing possibility of differential sticking, there is less top-drive torque being consumed in the interaction between the rotating casing and the wellbore, over the length of the wellbore, due to the smoother wellbore. The smoothness of the borehole, while primarily impacting the rotary torque, also results in better weight transfer to the bit, allowing reduced weight to be applied at the surface, and less weight directly on the bit, thereby reducing the depth of cut and the sticking action of the cutters. The top-drive requires less torque to rotate the casing string, and a far greater proportion of the top-drive generated torque reaches the bit. The torque that the string elements closest to surface must transmit, which otherwise might be very high, is reduced, and casing connectors may be of lesser torque capacity.

Figure 8:
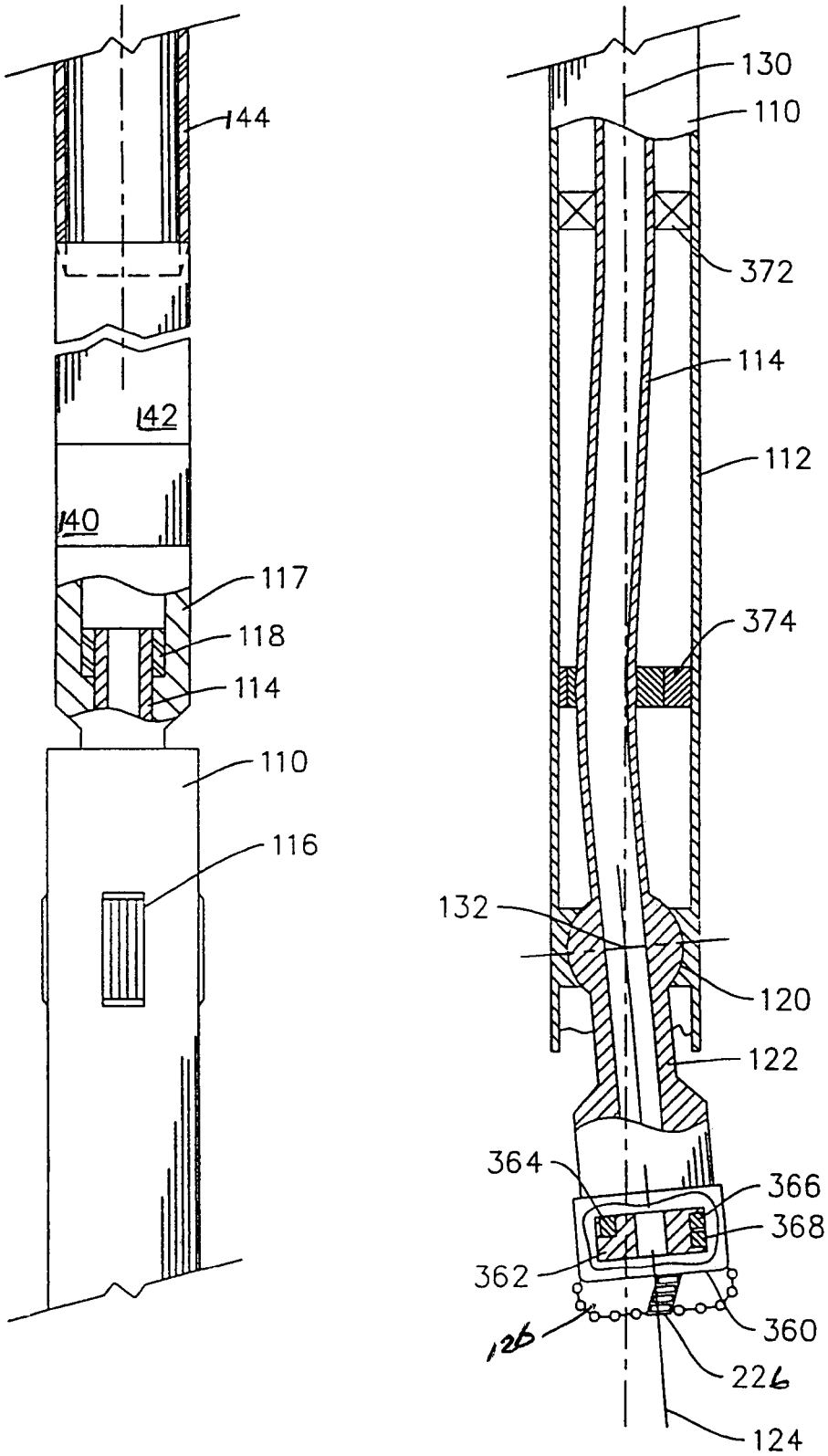
FIG. 8 illustrates a rotary steerable device within a bend in the rotary shaft.

FIG. 8 depicts another embodiment of a BHA according to the present invention. In one application, a driving source for rotating the bit is not a PDM motor, but instead a rotary steerable device (RSD), with the rotary steerable housing 112 receiving the shaft 114 which is rotated by rotating the casing string at the surface. Various bearing members 120, 374, 372 are axially positioned along the shaft 114. Those skilled in the art should understand that the rotary steerable device shown in FIG. 8 is highly simplified. The bit 360 may include various sensors 366, 368 which may be mounted on an insert package 362 provided with a data port 364. FIG. 8 shows the position of a portable MWD system 140 and a drill collar assembly 141.

A rotary steerable device (RSD) tilts or applies an off axis force to the bit in the desired direction in order to steer a directional well while the entire drill string is rotating. An RSD could replace a PDM in the BHA and the casing string rotated from the surface to rotate the bit, as discussed above. Preferably, a straight PDM may be placed above an RSD to power the RSD, which provides the steering capability for the BHA when conducting a casing drilling operation. Several advantages are achieved with this PDM/RSD combination for casing drilling: (i) increased rotary speed of the bit compared to the casing string rotary speed for a higher ROP; (ii) a source of closely spaced torque and power to the bit; (iii) less motor stalling problems than PDM alone since PDM generated torque may be supplemented by casing rotation; and (iv) improvements in hole cleaning while slowly rotating the casing during drilling.

FIG. 8 depicts a rotary steerable device (RSD) 110 which has a short bend to bit face length and a long gauge bit. While steering, directional control with the RSD is thus similar to directional control with the PDM. Significant benefits during a casing drilling operation may thus be obtained while steering with the RSD, and powering the RSD with a PDM, and preferably with a PDM supplemented by casing string rotation at the surface.

An RSD allows the driller to maintain the desired tool face and bend angle, while maximizing drill string RPM and increasing ROP. With this technology, the well bore has a smooth profile as the operator changes course. Local doglegs are minimized and the effects of tortuosity and other hole problems are significantly reduced. With this system, one optimizes the ability to complete the well while improving the ROP and prolonging bit life.

FIG. 8 depicts a BHA for drilling a deviated borehole in which the RSD 110 replaces the PDM. The RSD in FIG. 8 includes a continuous, hollow, rotating shaft 114 within a substantially non-rotating housing 112. Radial deflection of the rotating shaft within the housing by a double eccentric ring cam unit 374 causes the lower end of the shaft 122 to pivot about a spherical bearing system 120. The intersection of the central axis 130 of the housing 112 and the central axis 124 of the shaft below the spherical bearing system 124 defines the bend 132 for directional drilling purposes. While steering, the bend 132 is maintained in a desired tool face and bend angle by the double eccentric cam unit 374. To drill straight, the double eccentric cams are arranged so that the deflection of the shaft is relieved and the central axis of the shaft below the spherical bearing system 124 is put in line with the central axis 130 of the housing 112. The features of this RSD are described below in further detail.

The RSD 110 in FIG. 8 includes a substantially non-rotating housing 112 and a rotating shaft 114. Housing rotation is limited by an anti-rotation device 116 mounted on the non-rotating housing 112. The rotating shaft 114 is attached to the rotary bit 126 at the bottom of the RSD 110 and to drive sub 117 located near the upper end of the RSD through mounting device 118. A spherical bearing assembly 120 mounts the rotating shaft 114 to the non-rotating housing 112 near the lower end of the RSD. The spherical bearing assembly 120 constrains the rotating shaft 114 to the non-rotating housing 112 in the axial and radial directions while allowing the rotating shaft 114 to pivot with respect to the non-rotating housing 112. Other bearings rotatably mount the shaft to the housing including bearings at the eccentric ring unit 374 and the cantilever bearing 372. From the cantilever bearing 372 and above, the rotating shaft 114 is held substantially concentric to the housing 112 by a plurality of bearings. Those skilled in the art will appreciate that the RSD is simplistically shown in FIG. 8, and that the actual RSD is much more complex than depicted in FIG. 8. Also, certain features, such as bend angle and. short lengths, are exaggerated for illustrative purposes.

Bit rotation when implementing the RSD may be powered at the surface, or may be powered by a PDM above the RSD, or both. In the first application, rotation of the casing string 144 by the drilling rig at the surface causes rotation of the BHA above the RSD, which in turn directly rotates the rotating shaft 114 and rotary bit 126. In the second application, a PDM without a bend provided above the RSD powers the shaft 114, which then rotates the bit. Bit rotation may be supplemented by rotating the casing string from the surface while powering the PDM.

While steering, directional control is achieved by radially deflecting the rotating shaft 114 in the desired direction and at the desired magnitude within the non-rotating housing 112 at a point above the spherical bearing assembly 120. In a preferred embodiment, shaft deflection is achieved by a double eccentric ring cam unit 374 such as disclosed in U.S. Pat. Nos. 5,307,884 and 5,307,885. The outer ring, or cam, of the double eccentric ring unit 374 has an eccentric hole in which the inner ring of the double eccentric ring unit is mounted. The inner ring has an eccentric hole in which the shaft 114 is mounted. A mechanism is provided by which the orientation of each eccentric ring can be independently controlled relative to the non-rotating housing 112. This mechanism is disclosed in U.S. application Ser. No. 09/253,599 filed Jul. 14, 1999 entitled "Steerable Rotary Drilling Device and Directional Drilling Method." By orienting one eccentric ring relative to the other in relation to the orientation of the non-rotating housing 112, deflection of the rotating shaft 114 is controlled as it passes through the eccentric ring unit 374. The deflection of the shaft 114 can be controlled in any direction and any magnitude within the limits of the eccentric ring unit 374. This shaft deflection above the spherical bearing system causes the lower portion of the rotating shaft 122 below the spherical bearing assembly 120 to pivot in the direction opposite the shaft deflection and in proportion to the magnitude of the shaft deflection. For the purposes of directional drilling, the bend 132 occurs within the spherical bearing assembly 120 at the intersection of the central axis 130 of the housing 112 and the central axis 124 of the lower portion of the rotating shaft 122 below the spherical bearing assembly 120. The bend angle is the angle between the two central axes 130 and 124. The pivoting of the lower portion of the rotating shaft 122 causes the bit 20 to tilt in the intended manner to drill a deviated borehole. Thus the bit tool face and bend angle controlled by the RSD are similar to the bit tool face and bend angle of the PDM. Those skilled in the art will recognize that use of a double eccentric ring cam is but one mechanism of deviating the bit with respect to a housing, for purposes of directional drilling with an RSD.

While steering, directional control with the RSD 110 is similar to directional control with the PDM. The central axis 124 of the lower portion of the rotating shaft 122 is offset from the central axis 130 of the non-rotating housing 112 by the selected bend angle. For purposes of analogy, the bearing package assembly in the lower housing of the PDM is replaced by the spherical bearing assembly in the RSD 110. The center of the spherical bearing assembly 120 is coincident with the bend 132 defined by the intersection of the two central axes 124 and 130 within the RSD 110. As a result, the bent housing and lower bearing housing of the PDM are not necessary with the RSD 110. The placement of the spherical bearing assembly at the bend and the elimination of these housings results in a further reduction of the bend 132 to bit face 226 distance along the central axis 124 of the lower portion of the rotating shaft 122.

When it is desired to drill straight, the inner and outer eccentric rings of the eccentric ring unit 374 are arranged such that the deflection of the shaft above the spherical bearing assembly 120 is relieved and the central axis 124 of the lower portion of the rotating shaft 122 is coaxial with the central axis 130 of the nonrotating housing 112. Drilling straight with the RSD is an improvement over drilling straight with a PDM because there is not a bend in the RSD housing, and the RSD housing need not be rotated. Housing stresses on the PDM will be absent and the borehole should be kept closer to gauge size.

As with the PDM, the axial spacing along the central axis 124 of the lower portion of the rotating shaft 122 between the bend 132 and the bit face 22 for the RSD application could be as much as twelve times the bit diameter to obtain the primary benefits of the present invention. In a preferred embodiment, the bend to bit face spacing is from four to eight times, and typically approximately five times, the bit diameter. This reduction of the bend to bit face distance means that the RSD can be run with less bend angle than the PDM to achieve the same build rate. The bend angle of the RSD is preferably less than 0.6 degrees and is typically about 0.4 degrees. The axial spacing along the central axis 130 of the non-rotating housing 112 between the uppermost end of the RSD 110 and the bend 132 is approximately 25 times the bit diameter. This spacing of the RSD is well within the comparable spacing from the uppermost end of the power section of the PDM to the bend of 40 times the bit diameter.

The RSD 110 shown in FIG. 8 utilizes a short bend 132 to bit face 22 length that is less than the limit of twelve times the bit diameter. The total gauge length of the bit is longer than the required minimum length of 0.75 times the bit diameter, and at least 50% of the total gauge length is substantially full gauge. The bend angle in FIG. 8 is between the central axis of the lower portion of the rotating shaft 124 and the central axis of the non-rotating housing 112. The first point of contact between the BHA and the wellbore for the FIG. 8 motor is at the bit face. The second point of contact between the BHA and the wellbore at the upper end of the gauge section of the bit. The third point of contact between the BHA and the wellbore is higher up on the BHA. The curvature of the wellbore is defined by these three points of contact between the BHA and the wellbore.

Because the RSD has a short bend to bit face length and is similar to the PDM in terms of directional control while steering, the primary benefits of the present invention are expected to apply while steering with the RSD when run with a long gauge bit having a total gauge length of at least 75% of the bit diameter and preferably at least 90% of the bit diameter and at least 50% of the total gauge length is substantially full gauge. These benefits include higher ROP, improved hole quality, lower WOB and TOB, improved hole cleaning, longer curved sections, fewer collars employed, predictable build rate, lower vibration, sensors closer to the bit, better logs, easier casing run, and lower cost of cementing.

Several benefits are enhanced by the shorter bend to bit face length of the RSD compared to the PDM, which then means that a lower bend angle may be employed. When combined with the long gauge bit, these factors improve stability which is expected to improve borehole quality by reducing hole spiraling and bit whirling. Improved weight transfer to the bit is also expected. The shorter bend to bit face length of the RSD means that an acceptable build rate may be achieved even with a box connection at the lowermost end of the rotating shaft 114. A pin connection may be used at this location and some additional improvement to the build rate may be expected.

An additional enhancement is that the RSD may contain sensors mounted in the non-rotating housing 112 and a communication coupling to the MWD. The ability to acquire near bit information and communicate that information to the MWD is improved when compared with the PDM. As with the PDM, sensors may be provided on the rotating bit when run with the RSD.

The non-rotating housing 112 of the RSD may contain the anti-rotation device 116 which means the housing is not slick as with the PDM. The design of the anti-rotation device is such that it engages the formation to limit the rotation of the housing without significantly impeding the ability of the housing to slide axially along the borehole when the RSD is run with a long gauge bit. Therefore, the effect of the anti-rotation device on weight transfer to the bit is negligible.

With the exception of the anti-rotation device, the non-rotating housing 112 of the RSD is preferably run slick. However, there may be cases where a stabilizer may be utilized on the non-rotating housing near the bend 132. One reason for the use of a stabilizer is that the friction forces between the stabilizer and the borehole would help to limit the rotation of the non-rotating housing. The drag on the RSD will likely be increased due to this stabilizer, as with a stabilizer on the PDM. However, with the RSD the effect of this stabilizer on weight transfer to the bit should be more than offset by the decrease in drag due to rotation of the drill string while steering.

The orientation tool used to orient the bend angle of the PDM is no longer required because the RSD maintains directional control of the rotary bit. A straight PDM or electric motor may thus be placed in the BHA above the RSD as a source of rotation and torque for the bit.

According to the present invention, the connectors along the casing string need not be as costly or robust as prior art casing connectors for casing drilling operations. The casing connectors according to this present invention may thus be designed to withstand less torque than prior art casing connectors, and preferably have a yield torque which satisfies the relationship:

$$CCYT \leqq 5500+192\ (OD-4.5)^3 \qquad \text{Equation 1}$$

wherein the casing connector yield torque or CCYT is expressed in foot-pounds, and the casing outer diameter or OD is expressed in inches. The casing connection yield torque is thus the maximum torque which may be applied to the connector, since torque in excess of that value theoretically may result in the connector yielding and thus failing, either mechanically (possible separation of the casing string) on hydraulically (possible fluid leakage past or through the connection). In vertical or low inclination wells, the normal force of the casing string on the wall of the wellbore is small, so the yield torque would be proportional to casing OD. In high inclination wells, however, the normal force is substantially the weight of casing, which is a function of the steel density and the square of the casing diameter. In horizontal wells, the yield torque would be proportional to the cube of the casing string OD. The connection yield torque may thus be set for the worse case, i.e., a horizontal well, then used in a vertical well, a well slightly inclined at less than about 5, and in a horizontal or substantially horizontal well. For many casing drilling applications, the CCYT according to the present invention may be significantly less than the prior art, and may be defined by the relationship:

$$CCYT \leqq 5550+144\ (OD-4.5)^3 \qquad \text{Equation 2}$$

which is approximately 60% of the connector yield torque capability of torque connectors commonly used in casing drilling operations. In still other applications, the connector yield torque may be defined by the relationship:

$$CCYT=5550+96\ (OD-4.5)^3 \qquad \text{Equation 3}$$

In some shallow well and/or vertical well applications, the reduced drag of the casing string on the borehole and the use of a comparatively low torque rating motor may allow for even lower torque ratings for the connectors, satisfying the relationship:

$$CCYT=5550+48\ (OD-4.5)^3 \qquad \text{Equation 4}$$

Figure 6:
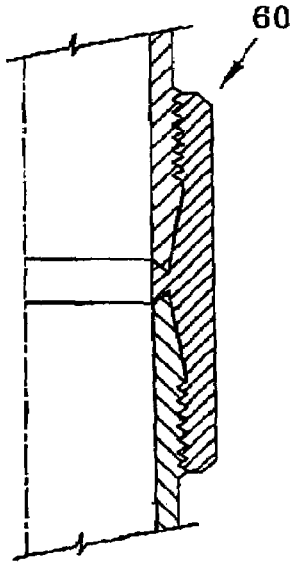
FIG. 6 illustrates a low cost casing connector for use along the casing string according to this invention.
Figure 7:
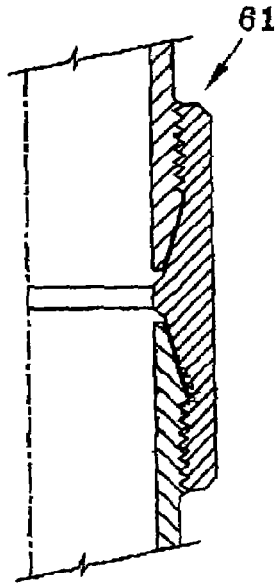
FIG. 7 illustrates an API casing connector for use along the casing string.

According to the invention, the BHA is much less prone to this torque spiking, and the PDM used may have a comparatively low torque rating. Further, the casing joint connectors do not require special high strength, and in some embodiments may have strength comparable to or may be the standard API connectors (API RP 5C1, 18th Edition, 1999). FIG. 6 depicts a casing connector 60 according to the present invention which includes a tapered shoulder on the coupling for engagement with a lower end of an upper casing joint and an upper end of a lower casing joint, although the casing joint connectors 60 as shown in FIG. 6 need not be as costly or robust as prior art drilling with casing connectors. FIG. 7 shows an alternative casing connector 61 with a coupling connecting upper and lower joints, and tapered seal surfaces on the end of each joint engaging a mating surface on the coupling. Connector 61 as shown in FIG. 7 may thus be similar to an API connection. This, and the reduced likelihood of connection failures, represents a significant cost savings.

According to the method of the invention, the bottom hole assembly with the downhole motor as discussed above is assembled for use in a casing drilling operation. When making up the connectors of the casing string, the makeup torque on the threaded connectors is controlled to be less than the yield torque which satisfies Equation 1, and preferably less than the yield torque which satisfies Equation 2. In many operations, the make-up torque may be even further reduced to be less than the yield torque which satisfies Equation 3, and in some applications the make-up torque may be sufficiently low to satisfy Equation 4. The threaded joints of the casing string are thus made up to a selected make-up torque which is less than the yield torque, and may be selectively controlled to a desired level by controlling the maximum output from the power tongs which supply the make-up torque. Make-up torque for the casing string connectors preferably is recorded to ensure that the make-up torque for each of the connectors is less than the yield torque.

Yet another benefit of the present invention is that the size of the bit (reamer) may be reduced. Table 1 gives specific dimensions for a pilot bit and reamer in the open position. The hole enlargement is in excess of 40% between the pilot bit and the open reamer. If the hole enlargement can be reduced, significant savings would inherently result by drilling a smaller diameter borehole. The reamer hole diameter according to the prior art is in excess of about 125%, and most commonly about 130%, of the casing OD. Table 2 depicts the same casing, with the same pilot bit size, and provides for the smaller diameter reamer which results in a significant reduction in hole enlargement. As indicated in Table 2, hole enlargement may be less than 40% and, in many cases, less than about 35%. The ratio of the reamed hole diameter to the casing OD as shown in Tables 1 and 2, which is 122% or less, preferably 120% or less, and commonly about 115% or less than the casing OD according to this invention, points out the significant advantages of this invention over the prior art.

TABLE 1

| Casing Size (inches) | Pilot Bit Size (inches) | Reamer (open) (inches) | Hole Enlargement | Reamed Hole/ Casing OD |
|---|---|---|---|---|
| 13⅜ | 12¼ | 17½ | 43% | 131% |
| 9⅝ | 8½ | 12¼ | 44% | 128% |
| 7⅝ | 6¼ | 10 | 60% | 132% |
| 5½ | 4¾ | 6⅞ | 45% | 125% |

TABLE 2

| Casing Size (inches) | Pilot Bit Size (inches) | Reamer (open) (inches) | Hole Enlargement | Reamed Hole/ Casing OD |
|---|---|---|---|---|
| 13⅜ | 12¼ | 16 | 31% | 120% |
| 9⅝ | 8½ | 11 | 29% | 114% |
| 7⅝ | 6¼ | 8½ | 36% | 115% |
| 5½ | 4¾ | 6⅛ | 29% | 112% |

Reducing hole enlargement will therefore increase rate of penetration, and improve reamer reliability both when cutting and when being retrieved though the casing, and will significantly reduce drilling costs.

It will be understood by those skilled in the art that the embodiment shown is exemplary, and that various modifications may be made in the practice of the invention. Accordingly, the scope of the invention should be understood to include such modifications which are within the spirit of the invention, as defined by the following claims.

What is claimed is:

1. A method of drilling a bore hole utilizing a bottom hole assembly including a downhole motor having an upper power section with a power section central axis and a lower central axis, the bottom hole assembly further including a bit rotatable by the motor and having a bit face defining a bit cutting diameter greater than an outer diameter of a casing string run in the well with the bottom hole assembly, the method comprising:

securing a gauge section below the bit, the gauge section having a substantially uniform diameter rotating bearing surface thereon while rotating along an axial length of at least about 60% of a pilot diameter, the bit diameter being less than about 122% of the casing string outer diameter;

providing the pilot bit secured to and below the gauge section; and rotating the bit, the gauge section and the pilot bit by pumping fluid through the downhole motor to drill the borehole.

2. A method as defined in claim 1, wherein the bit is a reamer secured to and above the gauge section, such that the bit face is the reamer face.

3. A method as defined in claim 1, wherein the gauge section has an axial length of at least 75% of the pilot bit diameter.

4. A method as defined in claim 1, wherein a portion of the gauge section has the substantially uniform diameter rotating bearing surface which is no less than about 50% of the axial length of the gauge section.

5. A method as defined in claim 1, further comprising:

providing a pin connection at a lower end of the downhole motor; and providing a box connection at an upper end of the bit for mating interconnection with the pin connection.

6. A method as defined in claim 1, further comprising:

providing cutters on the bit which radially move between an outward position for cutting a borehole greater than an outer diameter of the casing and a retrieval position wherein the downhole motor and bit are retrieved to the surface.

7. A method as defined in claim 1, wherein the downhole motor is a positive displacement motor with the power section central axis substantially concentric with the lower central axis; and a rotary steerable device positioned below and powered by the positive displacement motor.

8. A method as defined in claim 1, wherein the bit hole enlargement is less than about 40% greater than the pilot bit diameter.

9. A method as defined in claim 1, wherein the motor is a positive displacement motor and the lower central axis is angled with respect to the power section central axis.

10. A method as defined in claim 1, wherein the bit is a bi-centered bit secured to and above the gauge section, such that the bit face is the bi-centered bit face.

11. A method as defined in claim 1, further comprising:

axially spacing a bend between the power section central axis and the lower central axis from the bit face less than fifteen times the bit diameter.

12. A method of drilling a bore hole utilizing a bottom hole assembly including a steering device having a rotary shaft with an upper section shaft axis and a lower section shaft axis angled with respect to the upper section shaft axis, the bottom hole assembly further including a reamer having a reamer face and reamer cutters defining a reamer cutting diameter greater than an outer diameter of a casing string run in the well with the bottom hole assembly, the method comprising:

securing a gauge section below the reamer, the gauge section having a substantially uniform diameter rotating bearing surface thereon while rotating along an axial length of at least 60% of a pilot bit diameter, the reamer cutting diameter being less than about 40% greater than the pilot bit diameter;

axially spacing the bend from the reamer face less than fifteen times the reamer cutting diameter;

providing the pilot bit secured to and below the gauge section;

rotating the pilot bit, the gauge section and the reamer to drill the borehole;

selectively either retracting or disconnecting the reamer cutters; and thereafter retrieving at least one of the steering device, the reamer, the gauge section and the pilot bit from the well while leaving the casing string in the well.

13. A method as defined in claim 12, wherein the gauge section has an axial length of at least 75% of the pilot bit diameter.

14. A method as defined in claim 12, further comprising:

the steering device is a positive displacement motor powered by passing fluid through the motor.

15. A method as defined in claim 12, further comprising:

a positive displacement motor with a power section central axis substantially concentric with a lower central axis; and the steering device is a rotary steerable device positioned below and powered by the positive displacement motor.

16. A system for drilling a bore hole utilizing a bottom hole assembly including a downhole motor having an upper power section with a power section central axis and a lower central axis, the bottom hole assembly further including a bit rotatable by the motor and having a bit face defining a bit cutting diameter greater than an outer diameter of a casing string run in the well with the bottom hole assembly, the system further comprising:

casing connectors along the casing string connected by a makeup torque less than casing connector yield torque, the casing connector yield torque satisfying the relationship CCYT ft-lbs$\leqq$5500 ft-lbs+192 ft-lbs/in$^3$ (OD in−4.5 in)$^3$, wherein CCYT is casing connector yield torque in foot pounds, and OD is the outer diameter of the casing string joints in inches;

a gauge section secured below the bit, the gauge section having a substantially uniform diameter rotating bearing surface thereon while rotating along an axial length of at least 60% of a pilot bit diameter;

the pilot bit secured to and below the gauge section; and at least one of the downhole motor, the bit, the gauge section and the pilot bit are retrieved from the well while leaving the casing string in the well.

17. A system as defined in claim 16, further comprising:

a pin connection at a lower end of the downhole motor; and a box connection at an upper end of the bit for mating interconnection with the pin connection.

18. A system as defined in claim 16, further comprising:

the motor is a positive displacement motor with the power section central axis substantially concentric with the lower section axis; and a rotary steerable device positioned below and powered by the positive displacement motor.

19. A method of drilling a bore hole utilizing a bottom hole assembly including a steering device having a rotary shaft with an upper section shaft axis and a lower section shaft axis angled with respect to the upper section axis, the bottom hole assembly further including a reamer having a reamer face defining a reamer cutting diameter greater than an outer diameter of a casing string run in the well with the bottom hole assembly, the method comprising:

providing casing connectors along the casing string connected by a makeup torque less than casing connector yield torque, the casing connector yield torque satisfying the relationship $$\text{CCYT ft-lbs} \leqq 5500 \text{ ft-lbs} + 192 \text{ ft-lbs/in}^3 (\text{OD in} - 4.5 \text{ in})^3$$

wherein CCYT is casing connector yield torque in foot pounds, and OD is the outer diameter of the casing string joints in inches;

securing a gauge section below the reamer, the gauge section having a substantially uniform diameter rotating bearing surface thereon while rotating along an axial length of at least 60% of a pilot bit diameter;

providing a pilot bit having the pilot bit diameter secured to and below the gauge section;

selectively rotating the reamer, the gauge section and the pilot bit; and retrieving at least one of the steering device, the reamer, the gauge section and the pilot bit from the well while leaving the casing string in the well.

20. A method as defined in claim 19, further comprising: the gauge section has an axial length of at least 75% of the pilot bit diameter.

21. A method as defined in claim 19, further comprising: providing a positive displacement motor with a power section central axis substantially concentric with a lower central axis; and the steering device is a rotary steerable device positioned below and powered by the positive displacement motor.

22. A method as defined in claim 19, further comprising: axially spacing a bend between the upper section shaft axis and the lower section shaft axis from the bit face less than fifteen times the reamer diameter.

23. A method as defined in claim 19, wherein a portion of the gauge section has the substantially uniform diameter rotating bearing surface which is no less than about 50% of the axial length of the gauge section.

24. A method of drilling a bore hole utilizing a bottom hole assembly including a downhole motor having an upper power section and a lower bearing section, the bottom hole assembly further including a reamer rotatable by the motor and having a reamer face defining a reamer cutting diameter greater than an outer diameter of a casing string run in the well with the bottom hole assembly, the method comprising:

securing a gauge section below the reamer, the gauge section having a uniform diameter rotating bearing surface thereon along an axial length of at least 60% of a pilot bit diameter;

providing a pilot bit having the pilot bit diameter secured to and below the gauge section, the hole enlargement from the reamer being less than 40% greater than the pilot bit diameter;

selectively rotating the reamer, the gauge section and the pilot bit by pumping fluid through the downhole motor to drill the borehole; and retrieving at least one of the downhole motor, the reamer, the gauge section and the pilot bit from the well while leaving the casing string in the well.

25. A method as defined in claim 24, further comprising: the gauge section has an axial length of at least 75% of the pilot bit diameter.

26. A method as defined in claim 24, further comprising: providing cutters on the reamer which radially move between an outward position for cutting a borehole greater than an outer diameter of the casing and a retrieval position wherein the downhole motor and bit are retrieved to the surface.

27. A method as defined in claim 24, further comprising: providing casing connectors along the casing string connected by a makeup torque less than casing connector yield torque, the casing connector yield torque satisfying the relationship $$\text{CCYT ft-lbs} \leqq 5500 \text{ ft-lbs} + 192 \text{ ft-lbs/in}^3 (\text{OD in} - 4.5 \text{ in})^3$$

wherein CCYT is casing connector yield torque in foot pounds, and OD is the outer diameter of the casing string joints in inches.

28. A method as defined in claim 24, wherein the casing connectors satisfy the relationship $$\text{CCYT ft-lbs} \leqq 5550 \text{ ft-lbs} + 144 (\text{OD in} - 4.5 \text{ in})^3$$

wherein CCYT is casing connector yield torque in foot pounds, and OD is the outer diameter of the casing string joints in inches.

29. A method as defined in claim 24, wherein a portion of the gauge section which has the substantially uniform diameter rotating bearing surface is no less than about 50% of the axial length of the gauge section, and the method includes axially spacing the bend from the reamer face less than fifteen times the reamer cutting diameter.

30. A system for drilling a bore hole utilizing a bottom hole assembly including a downhole motor having an upper power section and a lower bearing section, the bottom hole assembly further including a bit rotatable by the motor and having a bit face defining a bit cutting diameter greater than an outer diameter of a casing string run in the well with the bottom hole assembly, the system further comprising:

a gauge section secured below the bit, the gauge section having a uniform diameter rotating bearing surface thereon along an axial length of at least 75% of a pilot bit diameter, and the bit cutting diameter being less than about 40% greater than the pilot bit diameter;

a pilot bit having the pilot bit diameter secured to and below the gauge section; and at least one of the down hole motor, the bit, the gauge section and the pilot bit being retrievable from the well while leaving the casing string in the well.

31. A system as defined in claim 30, further comprising: a pin connection at a lower end of the down hole motor; and a box connection at an upper end of the bit for mating interconnection with the pin connection.

32. A system as defined in claim 30, further comprising: cutters on the bit radially movable between an outward position for cutting a borehole greater than an outer diameter of the casing and a retrieval position wherein the bottom hole assembly is retrieved to the surface.

33. A system as defined in claim 30, further comprising: casing connectors along the casing string connected by a makeup torque less than casing connector yield torque, the casing connector yield torque satisfying the relationship $$\text{CCYT ft-lbs} \leqq 5500 \text{ ft-lbs} + 192 \text{ ft-lbs/in}^3 (\text{OD in} - 4.5 \text{ in})^3$$

wherein CCYT is casing connector yield torque in foot pounds, and OD is the outer diameter of the casing string joints in inches.

34. A system as defined in claim 30, wherein the casing connectors satisfy the relationship $$\text{CCYT ft-lbs} \leqq 5550 \text{ ft-lbs} + 144 \text{ ft-lbs/in}^3 (\text{OD in} - 4.5 \text{ in})^3$$

wherein CCYT is casing connector yield torque in foot pounds, and OD is the outer diameter of the casing string joints in inches.

35. A system as defined in claim 30, wherein the casing connectors satisfy the relationship $$\text{CCYT ft-lbs} \leqq 5550 \text{ ft-lbs} + 96 \text{ ft-lbs/in}^3 (\text{OD in} - 4.5 \text{ in})^3$$

wherein CCYT is casing connector yield torque in foot pounds, and OD is the outer diameter of the casing string joints in inches.

36. A system as defined in claim 30, wherein the bit cutting diameter is less than about 122% of the casing string outer diameter.

* * * * *